US012055138B2

(12) United States Patent
Rawlings

(10) Patent No.: US 12,055,138 B2
(45) Date of Patent: Aug. 6, 2024

(54) SYRINGE PUMP

(71) Applicant: Fluid Metering, Inc., Syosset, NY (US)

(72) Inventor: David Lionel Rawlings, Sound Beach, NY (US)

(73) Assignee: Fluid Metering, Inc., Syosset, NY (US)

( * ) Notice: Subject to any disclaimer, the term of this patent is extended or adjusted under 35 U.S.C. 154(b) by 274 days.

(21) Appl. No.: 17/602,142

(22) PCT Filed: Dec. 9, 2020

(86) PCT No.: PCT/US2020/064005

§ 371 (c)(1),
(2) Date: Oct. 7, 2021

(87) PCT Pub. No.: WO2021/119125

PCT Pub. Date: Jun. 17, 2021

(65) Prior Publication Data

US 2022/0145879 A1 May 12, 2022

Related U.S. Application Data

(60) Provisional application No. 62/947,244, filed on Dec. 12, 2019.

(51) Int. Cl.
*F04B 53/16* (2006.01)
*F04B 9/02* (2006.01)
(Continued)

(52) U.S. Cl.
CPC ..... *F04B 53/166* (2013.01); *F04B 9/02* (2013.01); *F04B 13/00* (2013.01); *F04B 53/02* (2013.01);
(Continued)

(58) Field of Classification Search
CPC .. F04B 53/16; F04B 9/02; F04B 13/00; F04B 53/02; F04B 53/14; F04B 53/166;
(Continued)

(56) References Cited

U.S. PATENT DOCUMENTS 3,390,815 A * 7/1968 Kavan ..... G01F 11/02 222/137
4,089,624 A * 5/1978 Nichols ..... F04B 9/02 604/152
(Continued)

FOREIGN PATENT DOCUMENTS

WO 2019152824 A1 8/2019

OTHER PUBLICATIONS wikipedia.org; O-ring—Wikipedia pdf from en.wikipedia.org/wiki/O-ring#:~:text=An%20O-ring%2C%20also%20known,a%20seal%20at%20the%20interface. (Year: 2023).*
(Continued)

*Primary Examiner* — Charles G Freay
*Assistant Examiner* — David N Brandt
(74) *Attorney, Agent, or Firm* — Hoffmann & Baron, LLP

(57) ABSTRACT

A syringe pump for aspirating and dispensing fluids is provided. The syringe pump includes a pump casing having an inlet port and an outlet port, a ceramic piston liner received within the pump casing and a ceramic piston. The liner has an internal bore formed by a cylindrical wall, wherein the cylindrical wall further defines a fluid path between the inlet port and the outlet port of the pump casing. The piston is axially movable within the bore of the piston to urge a flow of fluid between said inlet port and said outlet port via said fluid path.

21 Claims, 17 Drawing Sheets

(51) Int. Cl.

| | |
|---|---|
| ***F04B 13/00*** | (2006.01) |
| ***F04B 17/03*** | (2006.01) |
| ***F04B 19/22*** | (2006.01) |
| ***F04B 53/02*** | (2006.01) |
| ***F04B 53/14*** | (2006.01) |

(52) U.S. Cl.
CPC ..... *F04B 17/03* (2013.01); *F04B 19/22* (2013.01); *F04B 53/143* (2013.01)

(58) Field of Classification Search
CPC ..... F04B 17/03; F04B 19/22; F04B 49/065; F04B 53/143; F04B 9/047; F04B 7/06
See application file for complete search history.

(56) References Cited

U.S. PATENT DOCUMENTS

| | | | | |
|---|---|---|---|---|
| 4,479,759 | A * | 10/1984 | Zeitz | F04B 7/06 417/500 |
| 8,864,475 | B2 | 10/2014 | Bensley | |
| 2004/0220526 | A1 | 12/2004 | Boyne-Aitken | |
| 2005/0276705 | A1* | 12/2005 | Pinkerton, III | F04B 53/008 417/415 |
| 2010/0301069 | A1* | 12/2010 | Bensley | F04B 53/16 222/372 |
| 2019/0234399 | A1* | 8/2019 | Karunaratne | F04B 39/08 |

OTHER PUBLICATIONS ikont.com; Linear Way LWL Product Catalog pdf from ikont.com/linear-guides/ball-type-linear-motion-rolling-guides/ (Year: 2023).*

* cited by examiner

SYRINGE PUMP

CROSS-REFERENCE TO RELATED APPLICATION

This application claims the benefit of U.S. Provisional Application No. 62/947,244, filed Dec. 12, 2019, and which is incorporated herein by reference in its entirety for all purposes.

BACKGROUND

The present invention relates generally to liquid pumping systems, wherein a fluid is moved from a supply vessel to a receiving vessel. More particularly, the present invention relates to a mechanized syringe pump which can be used in various clinical analyzers. The present invention provides improvements, which render it more reliable in several areas of operation while retaining accuracy and function attributes.

U.S. Pat. No. 5,536,471 describes a mechanized syringe pump of the prior art that has now been in use for more than twenty-five years. Numerous design refinements have been implemented during this time without departing from the basic concepts disclosed in this patent. There are, however, several reliability problems, which continue to plague this mechanized syringe pump and despite considerable time and effort devoted to solving these problems, they remain troublesome. The problems can be summarized as follows:

1) Leakage of Fluid

After using the syringe for an extended period of time, fluid begins to leak past the seal. The leaking fluid problem is ubiquitous among these pumps and has been so intractable that drainage channels are formed into the syringe chassis body to prevent liquid rising inside the drive mechanism and causing irreversible corrosive damage.

2) Jamming of the Axial Drive

The syringe piston is driven in and out of the syringe body by means of a motorized threaded rod. Connection of the threaded rod to the piston is accomplished by means of a coupling which is securely fastened to both of these elements. The coupling floats inside the device chassis and is constrained from rotational movement by a ball bearing mounted underneath the coupling and riding in a close fitting channel formed into the bottom of the chassis. Rotation of the coupling must be avoided in order to allow axial movement of the coupling, threaded rod and piston in direct relation to rotation of a preloaded matching threaded split nut. The nut is turned by the motor and rotates in one direction while advancing the threaded rod and in the opposite direction when retracting the rod. Any rotation of the coupling cancels associated axial movement of the rod and piston. This is particularly undesirable when the axial movement is reversed, as happens when a precise volume of liquid is first aspirated by the syringe and then portions of that liquid are subsequently dispensed in a series of separate dispense movements. The rotation reversal of the drive occurs at the transition from aspirate to dispense, but only at the first dispense. Subsequent dispenses are made without rotation reversal. Loss of axial movement registers as loss of dispense volume for the first dispense and is such a common occurrence with mechanical syringes that electronic compensation is very often employed to correct the error. The needed close fitting relationship between the coupling bearing and the chassis slot invites occasional jamming of the bearing against the walls of the slot whenever dirt or debris lodges in the small gap therein. With a specified slot width of 0.503+0.002-0.000 and a bearing diameter of 0.5000 the available gap is only 0.003 to 0.005 inch.

3) Dispense Inaccuracy Due to Stiffness Limits

Syringe pumps offered for purchase in the market today most often employ separate removable glass bodied syringes which are mechanically mounted in a capturing/clamping means. The clamping means secures one end of the syringe, typically the cylindrical barrel, in a fixed position. The other end of the syringe, the plunger, is attached to a moveable clamping means. This mounting arrangement secures the fixed and moveable portions of the syringe in a cantilevered design such that whatever driving forces are applied to move the plunger in/out of the syringe barrel are necessarily off-axis. The off-axis forces imposed upon the off axis connection in such syringes necessarily results in some flexure of the cantilevered structural elements. Additionally, coupling of the parts with needed clearance for slide mechanisms results in some degree of looseness between connected elements. For example, U.S. Pat. No. 5,536,471 discloses a pump that incorporates a spring loaded split nut on the drive mechanism, which can yield inaccurate dispense results when the preload force of the spring is exceeded.

4) Dispense Inaccuracy Undetected

Various linear drive mechanisms are employed in conventional mechanized syringes available on the market. These drives use an assortment of motors coupled directly or indirectly (using gears, toothed belts and pulleys, etc.) to leadscrews, which in-turn are threaded into mating nuts. A variety of means are used to minimize backlash between the nut and leadscrew. All such designs are aimed at minimizing any difference between commanded and actual move distance. Additionally, there is a limit to how accurate the pitch can be controlled in manufacturing a lead screw. Unfortunately careful monitoring of motor, leadscrew or coupling gear does not provide a direct reading on actual syringe plunger movement. Backlash, flexure and looseness of coupling elements are completely disregarded by placing the encoder as described above.

Accordingly, it would be desirable to provide a syringe pump that addresses each of these problems and effectively addresses the fundamental causes. It would be further desirable to provide new approaches for overcoming the shortcomings of the existing design. It would also be desirable that the improved mechanical syringe be directly replaceable with the existing syringe so that no changes in mounting, fluid or electrical connections are required. It is still further desirable that no changes be needed to any of the programmed sequences as defined within the clinical analysis machine in order to utilize the improved pump.

SUMMARY OF THE INVENTION

In one aspect of the present disclosure, a syringe pump for aspirating and dispensing fluids is provided. The syringe pump includes a pump casing having an inlet port and an outlet port, a ceramic piston liner received within the pump casing and a ceramic piston. The liner has an internal bore formed by a cylindrical wall, wherein the cylindrical wall further defines a fluid path between the inlet port and the outlet port of the pump casing. The piston is axially movable within the bore of the piston to urge a flow of fluid between said inlet port and said outlet port via said fluid path.

The internal bore of the piston liner has an inner diameter and the piston has an outer diameter, wherein a total diametrical clearance between the inner diameter and the outer diameter is preferably in the range of 0.000100" to 0.000325". Also, the outer surface of the ceramic piston preferably has a hardness on the Vickers scale of about 1700.

In another aspect of the present invention, the syringe pump further includes an annular cartridge seal, and elastomeric washer and a gland nut. The annular cartridge seal circumferentially seals an outer surface of the ceramic piston at a proximal end of the ceramic liner. The elastomeric annular washer is disposed at the proximal end of the ceramic liner and the gland nut is attached to a proximal end of the pump casing. The gland nut presses the annular washer against the cartridge seal, whereby the cartridge seal is pressed against an end face of the proximal end of the ceramic liner.

In this embodiment, the annular cartridge seal preferably includes an annular shell and a spring element. The annular shell has an inner circumferential lip portion, an outer circumferential flange portion and an annular grove formed between the inner circumferential lip portion and the outer circumferential flange portion. The spring element is received within the annular groove of the shell, whereby the spring element radially urges the inner circumferential lip portion against the outer surface of the ceramic piston.

An inner radial portion of the annular washer is axially pressed against the outer circumferential flange portion of the shell by the gland nut, and an outer radial portion of the annular washer is axially pressed against the end face of the proximal end of the ceramic liner by the gland nut. In this case, the gland nut preferably has an axial face with an outer radial edge extending axially from an inner recessed axial surface. The outer radial edge presses the outer radial portion of the annular washer against the end face of the proximal end of the ceramic liner and the inner recessed axial surface presses the inner radial portion against the outer circumferential flange portion of the cartridge seal shell.

In another aspect of the present invention, the syringe pump further includes an annular scraper seal disposed between the annular cartridge seal and the gland nut. The scraper seal preferably includes an annular shell and a spring element similar to the cartridge seal. Specifically, the shell has an inner circumferential lip portion, an outer flange portion and an annular groove formed between the inner lip portion and the outer flange portion and the spring element is disposed within the groove for radially urging the lip portion against the outer surface of the ceramic piston. In this embodiment, the annular groove of the cartridge seal faces toward the ceramic liner, and the annular groove of the scraper seal faces away from the ceramic liner.

The fluid path defined in the liner can be provided by a pair of axial slots formed in an outer radial surface of the cylindrical wall of the liner and a transverse slot formed in an axial end face of the cylindrical wall of the liner, wherein the transverse slot fluidly connects the pair of axial slots.

Alternatively, the fluid path can be provided by a pair of internal grooves formed on an inner radial surface of the internal bore of the liner and a pair of transverse holes extending through the cylindrical wall of the liner.

In another aspect of the present invention, the syringe pump may include a pump housing defining an internal axial bore, a piston axially movable within the internal axial bore of the pump housing, a coupler attached to a distal end of the piston, a chassis and a drive mechanism for reciprocating the coupler in the axial direction. The coupler has a pair of roller bearings rotatably attached thereto and the chassis has a guide element for engaging the pair of roller bearings of the coupler, wherein each of the pair of coupler roller bearings traverses the guide element of the chassis. The roller bearings of the coupler are preferably spaced from each other in a direction transverse to the axial direction.

In one embodiment, the guide element comprises an axial slot formed in the chassis for receiving the pair of roller bearings of the coupler, wherein each of the pair of roller bearings of the coupler traverses an opposite wall of the axial slot. In an alternative embodiment, the guide element comprises a rail supported by the chassis, wherein each of the pair of roller bearings of the coupler traverses an opposite side of the rail.

In still another aspect of the present invention, the syringe pump includes a pump housing defining an internal axial bore, a piston axially movable within the internal axial bore of the pump housing, a coupler attached to a distal end of the piston, a chassis supporting the movable coupler and a drive mechanism for reciprocating the coupler in the axial direction. In this embodiment, the coupler has an optical encoder attached thereto and the chassis has a scale readable by the optical encoder of the coupler, whereby an axial position of the piston is determined by the optical encoder.

The scale is preferably attached to a scale support bar connected to the chassis, wherein the scale support bar has a flange portion and a projection extending from the flange portion. The scale is attached to a face of the projection extending into an interior of the chassis and one or more shims are preferably provided for adjusting a distance between the scale and the encoder.

Features of the disclosure will become apparent from the following detailed description considered in conjunction with the accompanying drawings. It is to be understood, however, that the drawings are designed as an illustration only and not as a definition of the limits of this disclosure.

DETAILED DESCRIPTION

Figure 1:
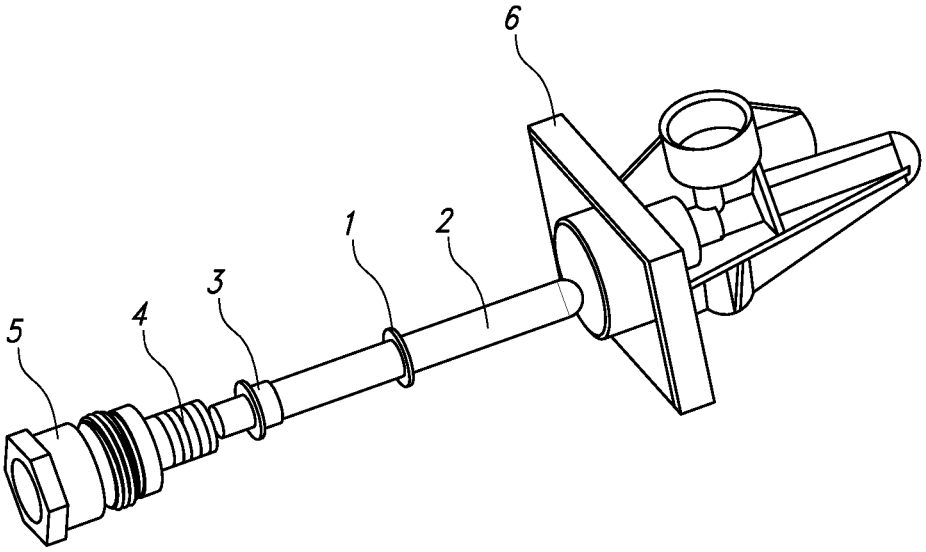
FIG. 1 (PRIOR ART)
FIG. 1 is an exploded perspective view of the internal components of a syringe pump of the prior art.
Figure 2:
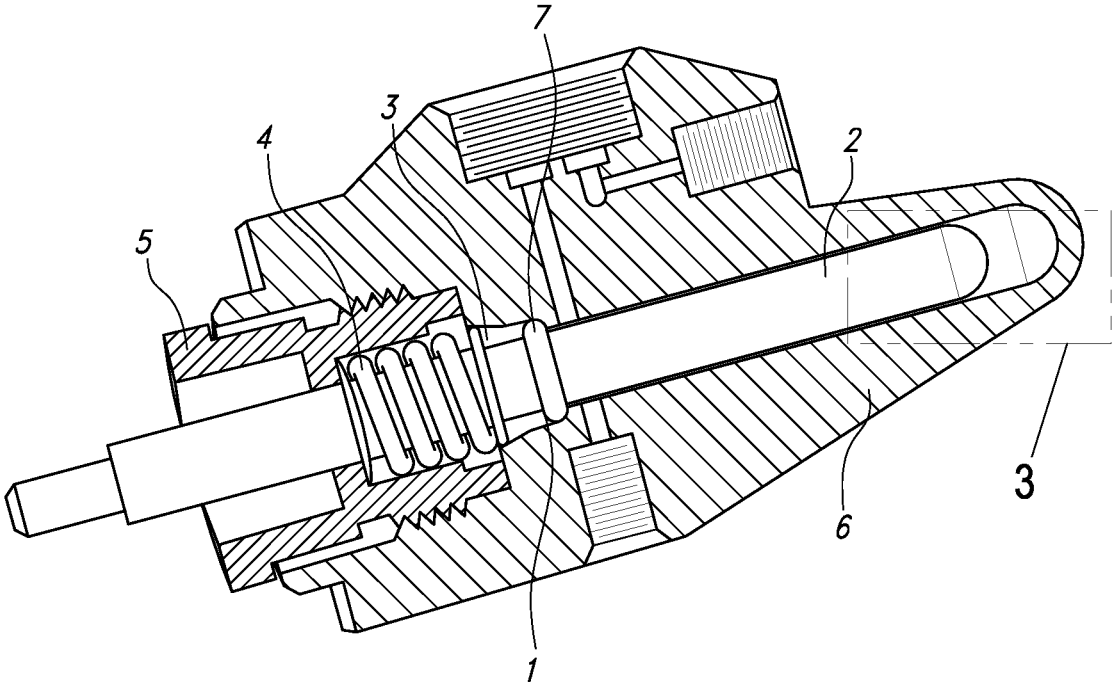
FIG. 2 (PRIOR ART)
FIG. 2 shows a cross-sectional view of the assembled seal arrangement of the syringe pump of the prior art shown in FIG. 1.

FIGS. 1 and 2 show the components of a conventional syringe pump of the prior art. The existing design employs a stainless steel piston 2, which passes through a tight fitting seal arrangement on its way into a syringe body 6. An elastomeric O-ring 1 is located on the piston 2. This O-ring 1 is urged axially by a seal member 3 against a wall 7 formed in the syringe housing 6. A spring 4 pushes the seal member 3 against the O-ring 1 and is itself forced axially in the same direction by a seal nut 5, which is threaded into the syringe body 6. The compressive forces on the O-ring 1 are such as to cause the O-ring inside diameter to squeeze down on the OD of the piston 2. The amount of compressive force and resulting drag on the piston 2 axial motion is controlled by suitable selection of the spring characteristics along with the amount of spring compression as defined by the confining space in which it resides.

It would be desirable to increase the tightness of this seal in order to minimize leakage, but there is an upper limit imposed by the aforementioned preloaded split nut. Available axial force cannot be allowed to exceed the preload limit of approximately six pounds force. Accordingly, the tightness of the existing seal squeeze is such that it requires approximately five (5) pounds of force to move the piston.

Figure 3:
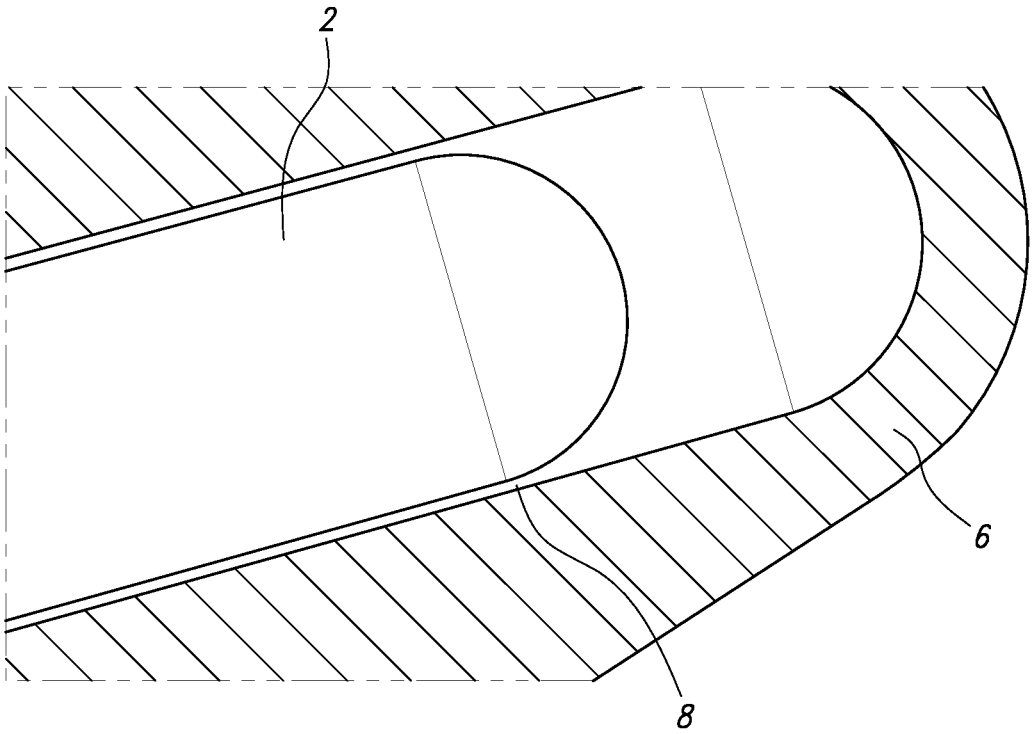
FIG. 3 (PRIOR ART)
FIG. 3 is an enlarged cross-sectional view of a portion of the syringe pump of the prior art shown in FIG. 1.

As shown in the enlarged cross-sectional view of FIG. 3, the piston 2 floats in an annular space 8 within the syringe body 6 and does not contact the chamber walls. This arrangement permits rocking motion of the piston with respect to the seal such that difficulty is encountered maintaining seal integrity. Additionally, the surface of the stainless steel piston 2 which is in sliding contact with the tightly squeezed compliant seal member 1 will wear after a limited number of cycles. Such wear will inevitably compromise surface finish integrity and smoothness of that portion of the piston surface which engages the seal.

Figure 4:
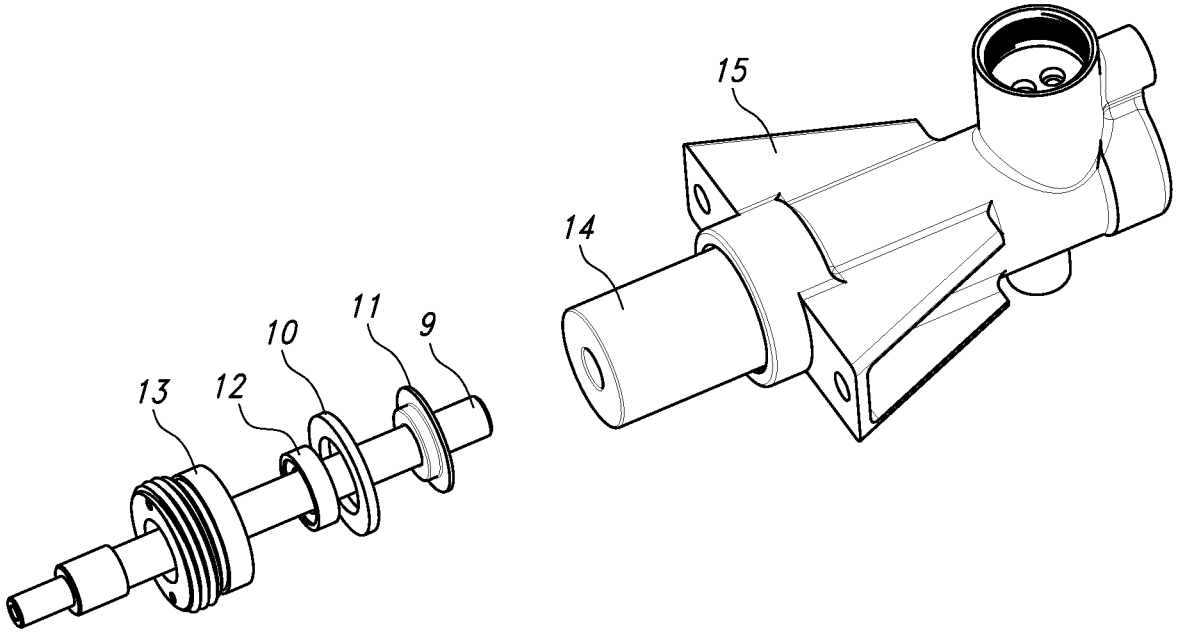
FIG. 4 is an exploded view of the internal components of a syringe pump according to the present invention.

Turning now to FIG. 4, the present invention substitutes a completely different syringe body, seal and piston design for the prior art unit described above. The syringe piston 9 of the present invention is made of extremely hard ceramic material, such as aluminum oxide. This piston 9 is closely fitted to a ceramic cylinder or liner 14 made from similar material as the piston. The diametrical clearance between these two parts is preferably on the order of 0.000005" such that there is virtually no "float" of the piston and all rocking motion is eliminated. Thus, the seal arrangement, which will be described in detail below, is subjected to nothing but axial motion of the piston and there is no other relative motion of the parts to contribute to seal leakage.

The hardness of the ceramic piston surface is approximately 1700 on the Vickers scale, while the 316 stainless steel piston used in the prior art design with a Vickers hardness of 152 is less than 1/10th as hard. Wear of the ceramic piston surface will obviously be far lower than experienced by the steel piston. The ceramic piston surface finish and integrity is unaffected after many millions of cycles.

Figure 5:
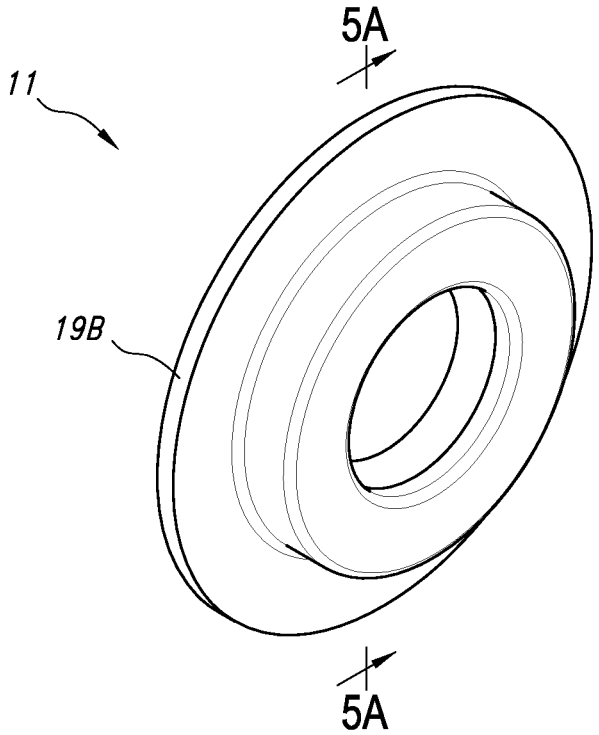
FIG. 5 is a perspective view of the cartridge seal of the present invention.
Figure 5A:
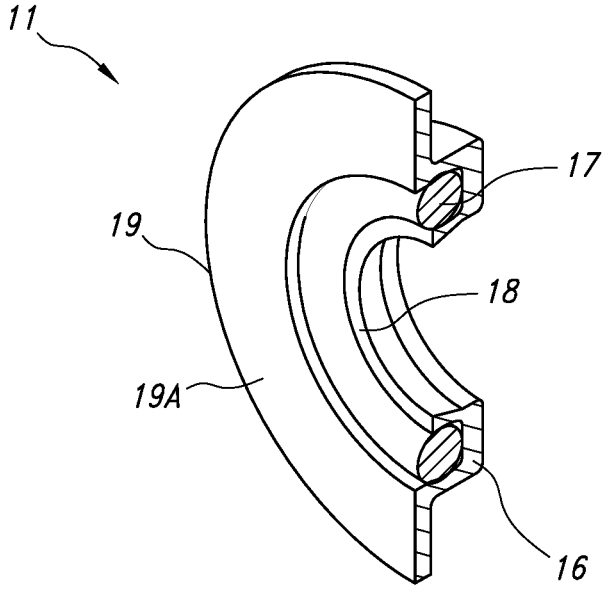
FIG. 5A is a cross-sectional view of the cartridge seal shown in FIG. 5, taken along the line 5*a*-5*a*.

Referring additionally to FIG. 5, the present invention utilizes a cartridge seal assembly 11 having an annular shell 16 made from a suitable wear resistant polymer, such as ultra-high-molecular-weight polyethylene (UHMWPE). The shell 16 has an annular groove formed between an inner circumferential lip portion 18 and an outer circumferential flange portion 19. The groove is sized to receive an energizer spring element 17 in such a manner that the lip portion 18 of the seal is urged radially inward against the piston surface by the energizer spring element 17. In a preferred embodiment, the energizer spring element 17 is an elastomeric O-ring.

Figure 6A:
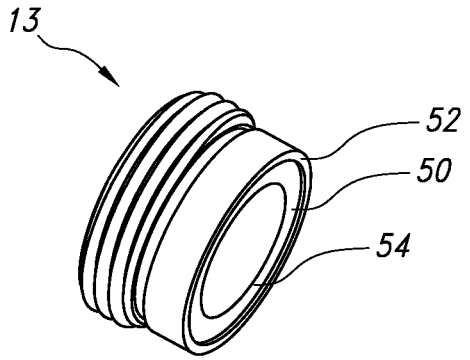
FIG. 6A is an isolated perspective view of the gland nut shown in FIG. 6.
Figure 6:
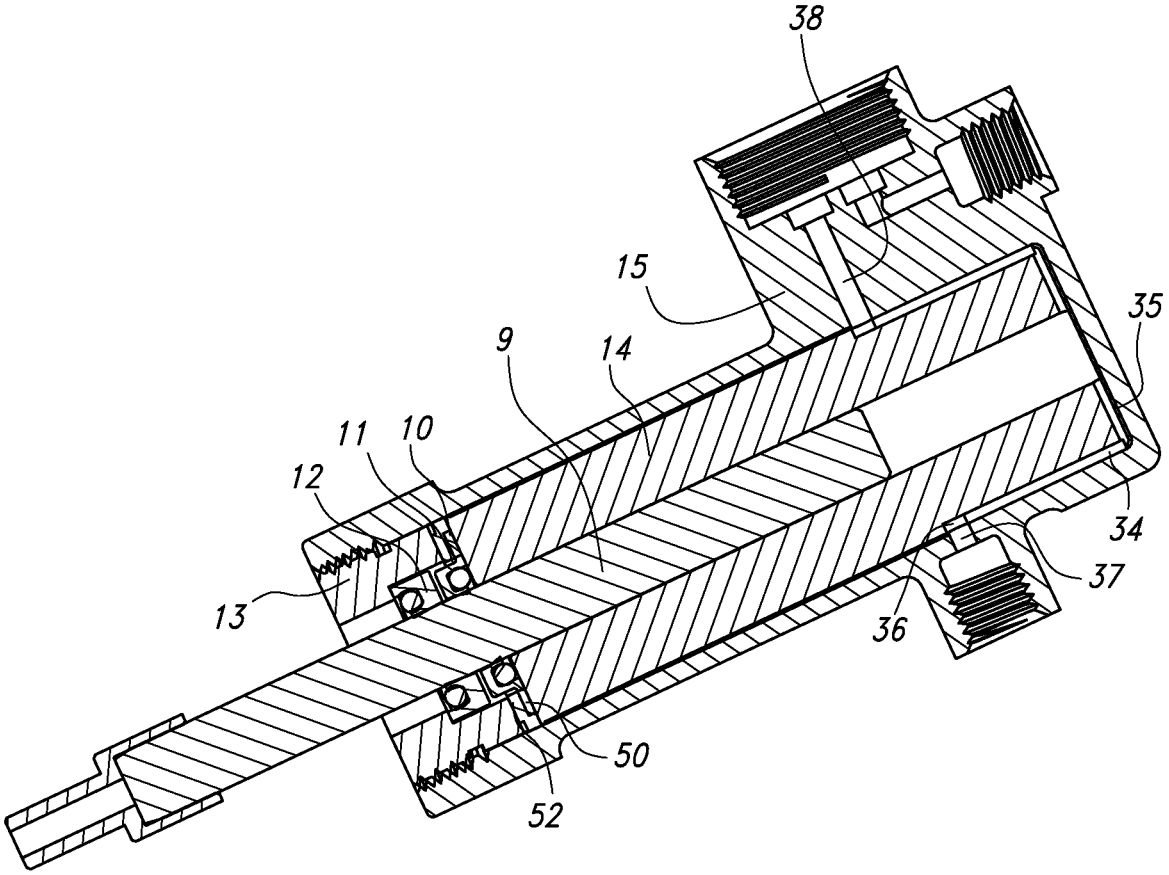
FIG. 6 is a cross-sectional view of a pump housing of a syringe pump according to the present invention.

Referring back to FIG. 4, and additionally to FIG. 6, a scraper seal 12 is positioned on the piston 9 outboard of the cartridge seal assembly 11. The purpose for the scraper seal 12 is to scrape crystalized residue from the outer surface of the piston 9 so that it is not drawn into contact with the lip 18 of the cartridge seal 11. Such crystal residue can be sufficiently abrasive to prematurely wear away material from lip 18 of seal 11.

The scraper seal 12 has a somewhat similar design as the cartridge seal 11 in that it includes an energizer element provided in an annular groove to urge an inner radial lip portion against the outer surface of the piston. It is preferred, however, that the scraper seal 12 is positioned on the piston such that the annular groove of the scraper seal 12 opens axially in the outboard direction away from the interior pump, while the annular groove of the cartridge seal 11 opens in an opposite inboard direction toward the interior of the pump housing.

As shown in FIG. 6, a beneficial feature of the design of the present invention is that it makes provision for accurate centering of the lip 18 of the cartridge seal 11 with respect to the outer diameter (OD) of the piston 9. Accurate centering is important for seal life as it uniformly distributes deflection of the lip 18 as it expands over the piston 9 during assembly.

Referring additionally to FIG. 5, the large diameter outer circumferential flange portion 19, formed as part of the shell 16, includes an inboard face 19A, facing toward the interior of the pump housing, and an opposite outboard face 19B, facing away from the interior of the pump housing. At assembly, the piston 9 is first inserted through the scraper element 12, then through a soft elastomeric annular washer 10, and finally through the cartridge seal 11. The piston 9, with its two seal elements 11, 12 and elastomeric washer 10, is then inserted into a liner 14 and gently brought home until the inboard face 19A of the shell flange 19 rests against the end face of the liner 14. At this point, the piston 9 is securely held radially within the close fitting bore of the liner 14 and the cartridge seal 11 has centered itself correctly on the piston 9. A gland nut 13 is then guided over the outboard end of the piston 9 and screwed into a syringe casing 15 forming the outer shell of the pump housing.

The inboard face 50 of the gland nut 13 has a stepped geometry, as shown in the enlarged isometric image detail of FIG. 6*a*. Specifically, the inboard face 50 of the gland nut 13 has an outer radial ridge 52 that extends in the axial direction from a recessed surface 54 defined radially inside the ridge. As the gland nut 13 is screwed into the housing 15, the outer ridge 52 bears down upon the elastomeric washer 10 squeezing it against the face of liner 14. Simultaneously the recessed portion 54 of the face 50 of the gland nut 13 presses the elastomeric washer 10 against the outboard flange surface 19B of the cartridge seal 11. As a result, the cartridge seal 11 partially buries itself in a radial true manner within the compliant washer 10.

This arrangement ensures that the cartridge seal 11 has been assembled concentric with the piston 9 and also provides a block to any leakage path around the flange 19 of the cartridge seal 11. Additionally, the squeezing of the elastomeric washer 10 causes its outer diameter to enlarge and press against the inner bore wall of the syringe casing 15. This provides sealing against the additional possible leakage path which can exist between the OD of liner 14 and the bore wall of syringe casing 15.

Figure 6B:
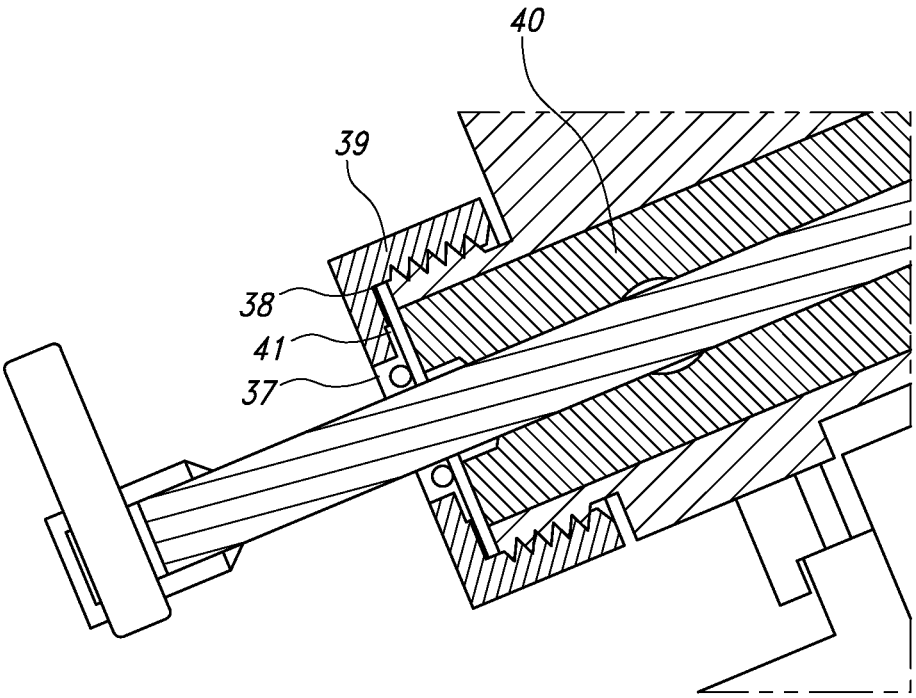
FIG. 6B (PRIOR ART)
FIG. 6B is a cross-sectional view of a pump housing of a syringe pump of the prior art.

As compared with the seal design of prior art pumps, as shown in FIG. 6B, the seal arrangement of the present invention differs considerably from that of the prior art. Most notable is the absence of a separate scraper component and placement of the elastomeric washer 38 between the face of flange 41 of cartridge seal 37 and the end face of liner 40. Additionally the novel internal gland nut 13 of the present invention is not used in the arrangement shown in FIG. 6B. The previous design employs an external gland nut 39.

As described above, the present invention contemplates using a ceramic piston 9 in conjunction with a close fitting ceramic liner 14, as shown in FIG. 4. Unlike the syringe design of the prior art, which employs two components (a steel piston and a molded plastic syringe housing), the use of a ceramic piston and liner requires three components, instead of two components, to accomplish the same purpose of a piston displacing a fluid volume. This third component is identified as the pump casing 15 in FIG. 4. The casing 15 allows for inexpensive forming of ports and mounting geometries which would not be practical if formed as part of the ceramic liner 14.

In the prior art syringe pump shown in FIG. 3, fluid is permitted to flow in the annular gap 8 provided between the piston 2 and the inner bore of the liner 6. In view of the tight fit between the piston 9 and the internal bore of the liner 14 of the present invention, an alternate fluid path is provided in the liner 14 of the present invention in order for the new syringe assembly design to work properly with the bubble flushing, aspiration and dispense functions called for in this specialized application.

Figure 7:
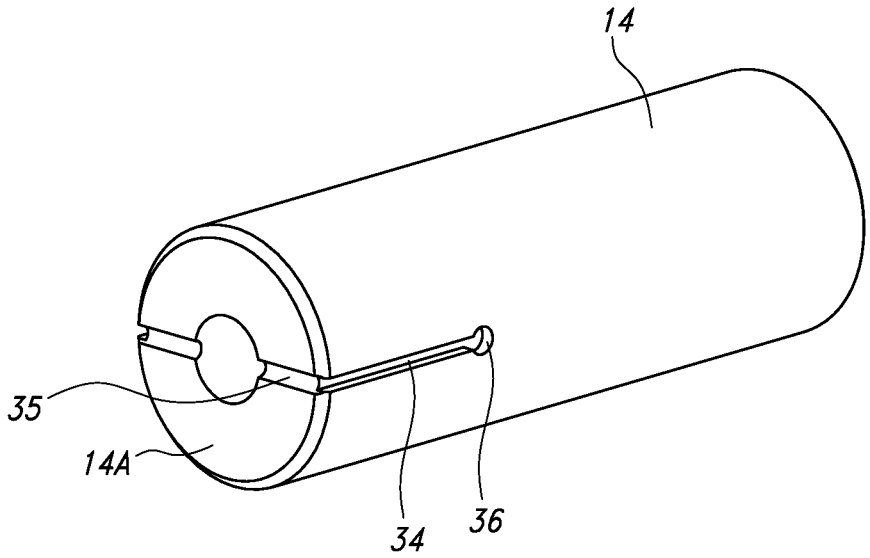
FIG. 7 is an isolated perspective view of the liner of the present invention.

FIG. 7 shows a first embodiment of a liner 14 used in the present invention. There are no ports communicating through the wall of this liner such as the ports of a conventional liner. Instead, two shallow slots 34 and two blind counter bores 36 are formed on opposite sides of the outer radial surface of the liner. The slots 34 run in the axial direction from the small blind counter bores 36, parallel to the liner axis, and end at the bottom end face 14*a* of liner 14. These slots 34 fluidly connect with transverse slots 35 cut into the bottom end face 14*a* of the liner. The counter bores 36 are positioned such that, upon assembly into syringe body 15, as shown in FIG. 6, they align with ports 37 and 38 of syringe body 15.

When it is necessary for the new design syringe to be exercised through its bubble flush sequence, the piston 9 is positioned in a variety of axial locations but particularly in the most inward or bottomed position. Flushing liquid is forced in through port 38 of syringe body 15, down one slot 34, across slots 35, back up the other liner slot 34 and then out port 37 of syringe body 15.

Figure 8:
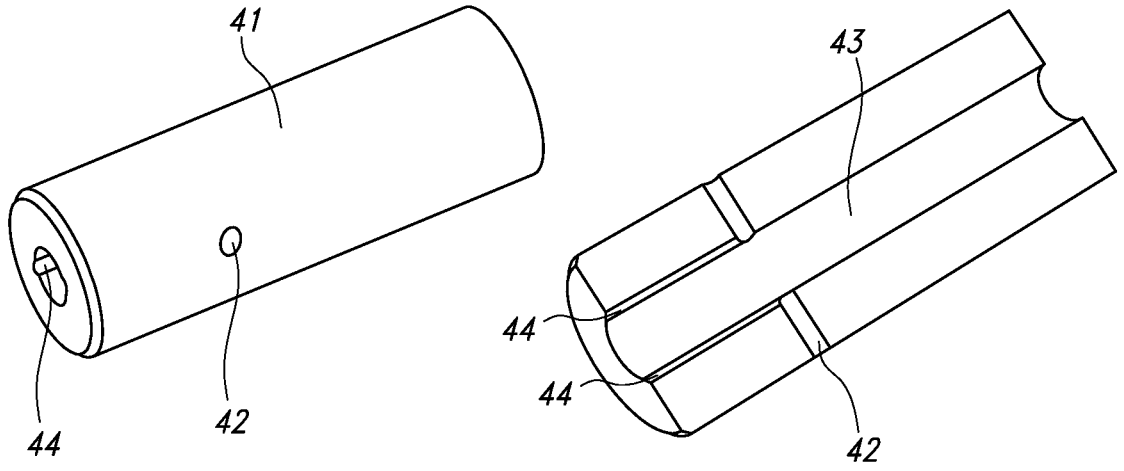
FIG. 8 is an isolated perspective view and a cross-sectional view of an alternative embodiment of the liner of the present invention.

An alternate embodiment of a liner 41 according to the present invention is shown in FIG. 8. Instead of the external channels cut into the outside of the liner 14, liner 41 has two internal grooves 44 cut into the inner bore 43 of the liner. These internal groves 44 communicate with transverse holes 42 cut through the walls of liner 41. The holes 42 are coaxial and extend from the outer surface of the liner 41 to the internal bore. The internal grooves 44 run in the axial direction from the holes 42 to the end face of the liner.

Figure 9:
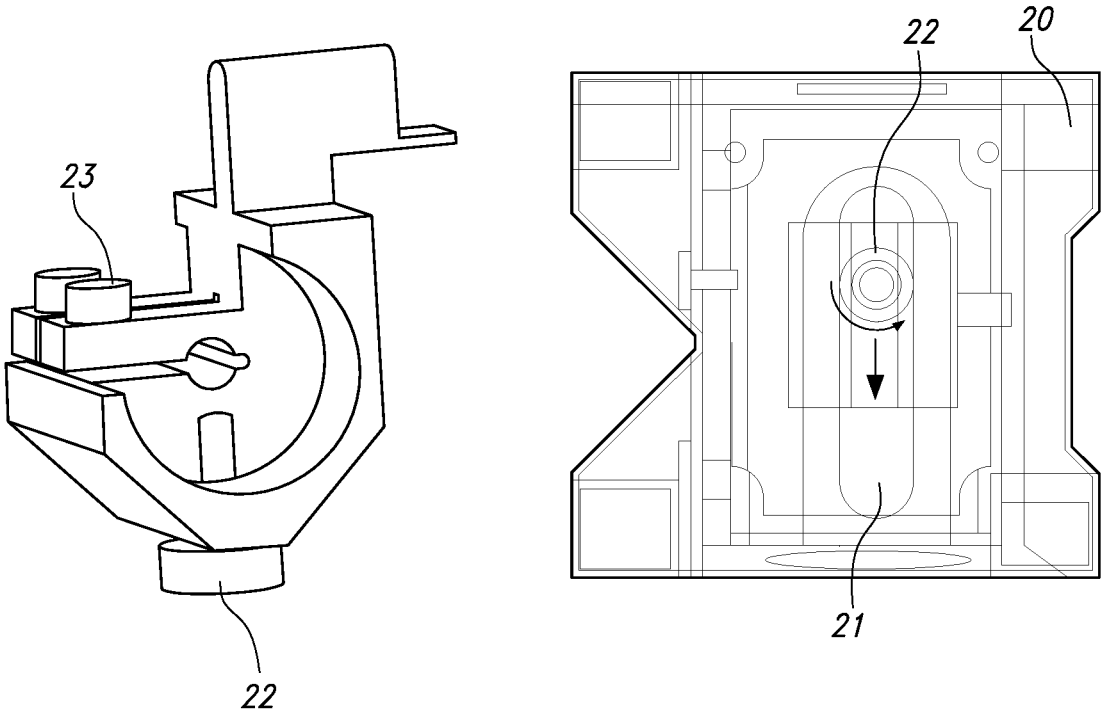
FIG. 9 (PRIOR ART)
FIG. 9 shows a coupler and chassis of the prior art.

As discussed above, another problem that arises with syringe pumps of the prior art is jamming of the axial drive mechanism for driving the piston. FIG. 9 shows a partial view of the prior art design of an axial drive mechanism with a chassis 20 configured with a slot 21 disposed in the center of the chassis walls and extending in the axial direction of the piston 2. A bearing 22 is rotatably fixed to a coupler 23 and the coupler is attached to the distal end of the piston 2 shown in FIG. 2. A drive mechanism (not shown), such as a motor, drives the coupler 23 in a reciprocating manner in the axial direction. During such motion, the bearing 22 of the coupler rides inside the slot 21 of the chassis 20, as the syringe piston 2 is retracted and advanced.

The outside diameter of the ball bearing 22 of this prior art design typically has a very close fitting relationship with the walls of the slot 21 such that a tight gap of 0.003" can be formed, depending upon what portion of allowed tolerance is employed in its manufacture. As can be seen in FIG. 9, linear movement of the bearing 22 as it traverses a path along the slot 21 will cause the outer race of the bearing to rotate clockwise or counterclockwise depending on the direction of travel, and which of the slot 21 walls is engaged by the outside surface of bearing 22 race. The side of the race which is not touching the slot wall will move in a direction opposite to the relative wall of slot 21 which it is passing by. This opposition encourages the high probability of jamming if any debris larger than the gap finds its way between the counter rotating bearing race and the passing nearby wall.

Figure 10:
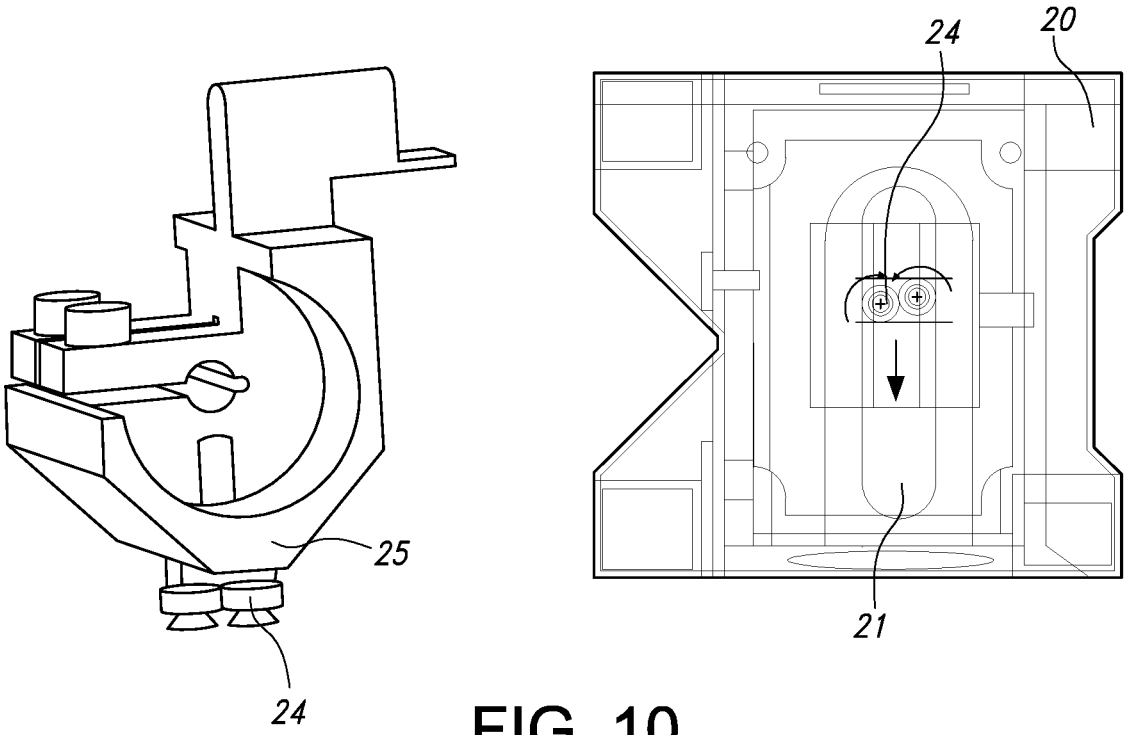
FIG. 10 shows a coupler and a chassis according to an aspect of the present invention.
Figure 10A:
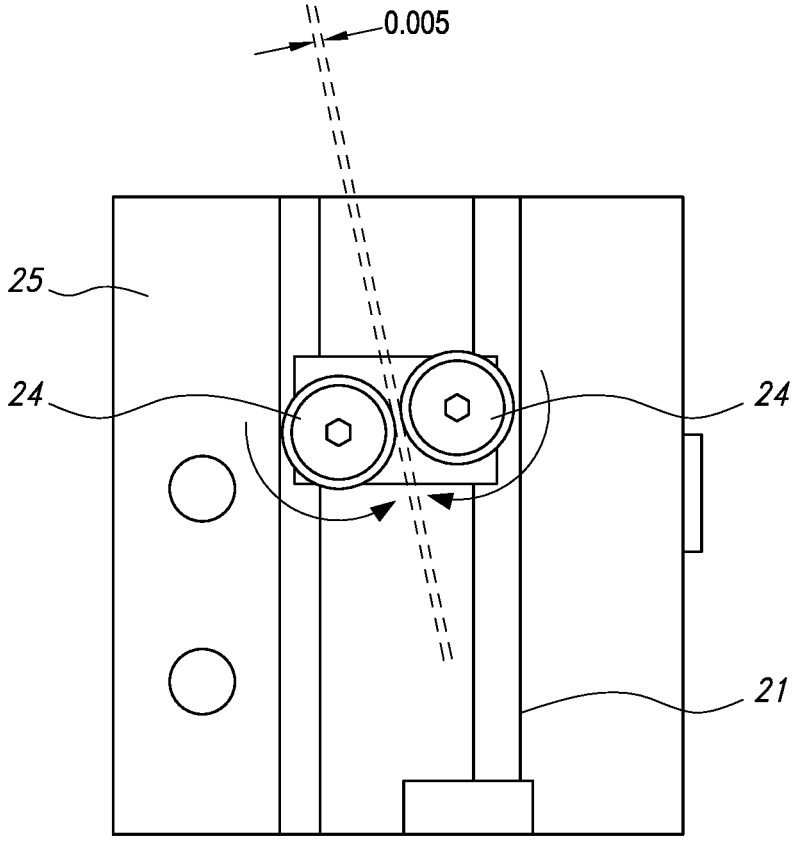
FIG. 10A is an enlarged view of the coupler bearings within the slot of the chassis shown in FIG. 10.
Figure 11:
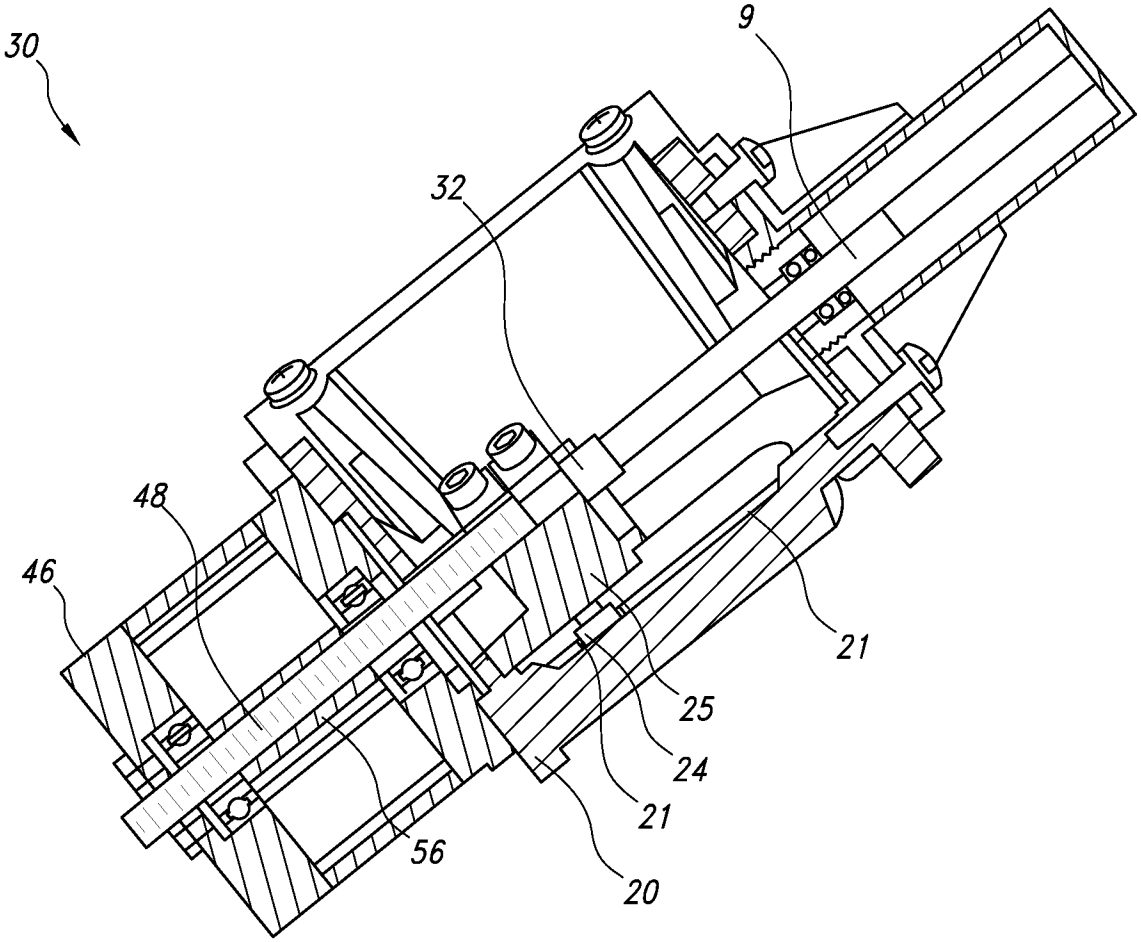
FIG. 11 is a cross-sectional view of the pump of the present invention with the coupler attached to the piston.

Turning now to FIGS. 10, 10A and 11, the present invention substitutes a pair of ¼" outside diameter ball bearings 24 mounted on a new design coupler 25. The bearings 24 are spaced apart from each other such that their outside races are purposely designed to engage the ½" width slot 21 walls with as much as 0.002" interference. As can be seen in FIG. 10A, this arrangement ensures that there is never the case where one of the bearings is rotating counter to a passing slot 21 wall. Instead, there is always rolling contact or very nearby glancing contact.

Any debris, which might find its way between the bearings 24 and walls of the slot 21, will simply be rolled over and jamming of the coupler and drive unit is thereby eliminated. In particular, it can be seen in FIG. 10A that the bearings 24 are offset such that a gap 27 of approximately 0.005" is created between the outer diameter of each bearing, while their outer races respectively engage the opposite walls of the ½" width slot 21.

If the bearings were aligned horizontally and not offset, they would contact each other. The coupler would still move freely, even if the bearings touched because rotation direction is such that rolling contact is always maintained. Small amounts of debris can be accommodated as the bearings will simply roll over them, but the slight gap helps to make this function more robust. An additional advantage of this design is the reduced rotational backlash permitted so that lead-screw reversals do not translate into small losses of linear movement. In short, accuracy of the system is improved.

FIG. 11 is a cross-sectional view of the pump 30 of the present invention with the coupler 25 attached to the piston 9. A support cap 32 is preferably provided to facilitate attachment of the piston 9 to the coupler 25. As described above with respect to the prior art, a drive mechanism 46, such as a motor, drives the coupler 25 in a reciprocating manner in the axial direction. The drive mechanism 46 includes a threaded rod 48 fixedly attached to the coupler 25 opposite the piston 9. An internally threaded split nut 56 is fixed to the drive mechanism 46 and the threaded rod 48 is threaded into the split nut to convert rotary motion of the rotating components within the drive mechanism into axial motion of the threaded rod 48. Such axial motion of the threaded rod 48 will axially displace the coupler 25, wherein the dual bearings 24 of the coupler will ride inside the slot 21 of the chassis 20, as the syringe piston 9 is retracted and advanced.

Figure 12:
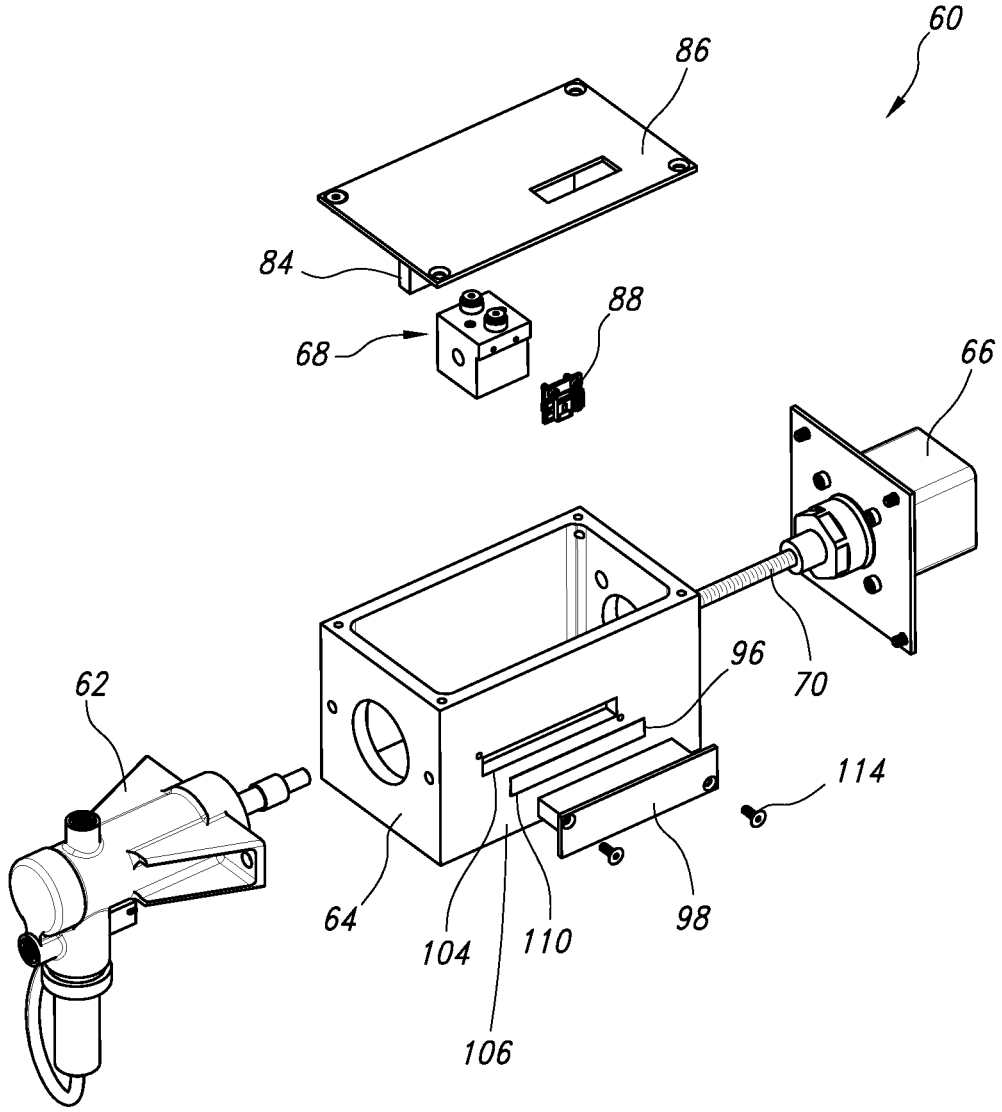
FIG. 12 is an exploded perspective view of an alternative embodiment of the pump of the present invention.
Figure 13:
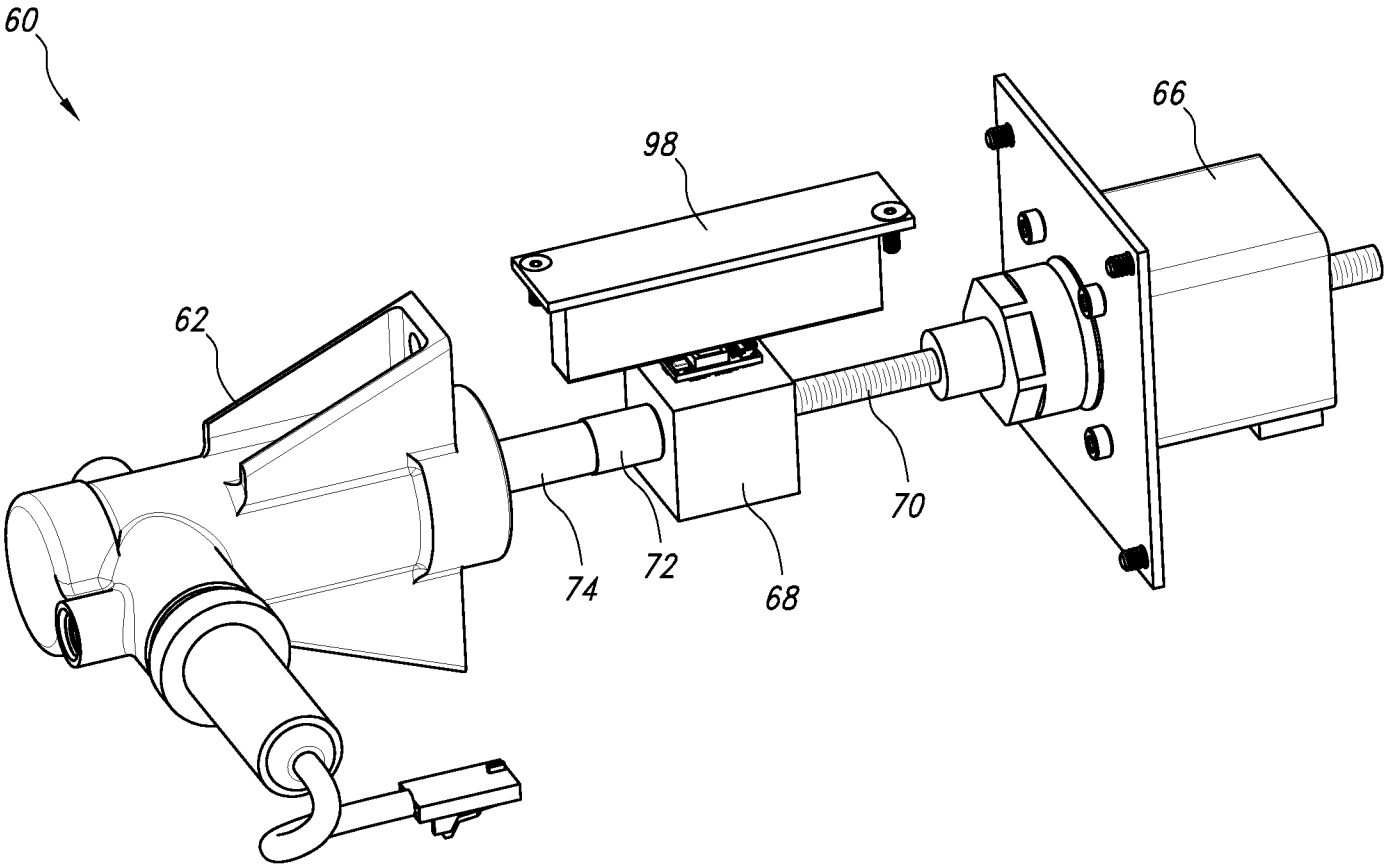
FIG. 13 is a perspective view of the pump shown in FIG. 12 in an assembled state with the chassis removed.

An alternative embodiment of the pump 60 of the present invention is shown in FIGS. 12 and 13. Similar to the embodiments described above, a pump head 62 is disposed at one end of a rectangular pump chassis 64 and the motor portion 66 of a linear drive mechanism is disposed at the opposite end of the chassis 64. The pump head 62 is similar to that fully described above. FIG. 13 shows this same syringe pump 60 with the chassis 64 removed so as to expose components inside which are normally hidden from view. Among those components contained within the chassis 64 is a coupler/encoder assembly 68 which is connected to the threaded end a lead screw 70 on one face of the coupler/encoder assembly and a piston support 72 on the opposite face. The piston support 72 is, in turn, connected to the piston 74 extending out of the pump head 62.

As can be seen in FIG. 13, the axis of the lead screw 70 is coincident with the axis of the pump piston 74 extending out of the pump head 62. It is this alignment of the drive axis with the piston axis that gives rise to the name "Direct Drive Syringe," which is one of the advantages of the present invention. Cantilevered offset is completely eliminated in this arrangement such that opposing forces exerted by the lead screw 70 and piston 74 do not result in flexure as suffered from other prior art designs. Additionally, there are no intermediate guide pieces between the lead screw 70 and the coupler/encoder assembly 68, such as found in prior art designs using toothed belts, gears and other components in order to translate lead screw rotation or axial movement into motion of the piston. Instead, the present design provides a completely solid connection from the lead screw 70 to the piston 74. This design requires use of a non-rotating lead screw linear actuator 66 of which numerous versions are readily available on the market.

Figure 14:
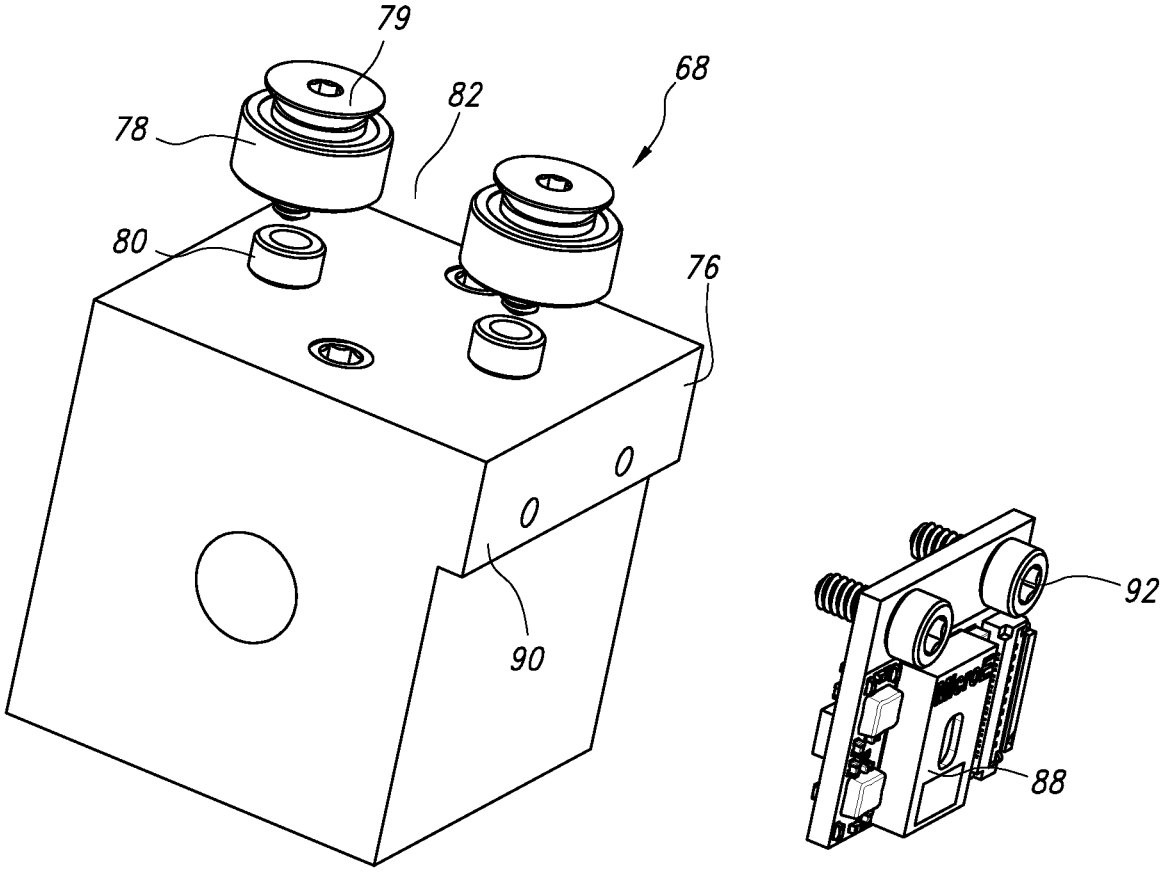
FIG. 14 is an isolated exploded perspective view of the coupler shown in FIGS. 12 and 13.
Figure 15:
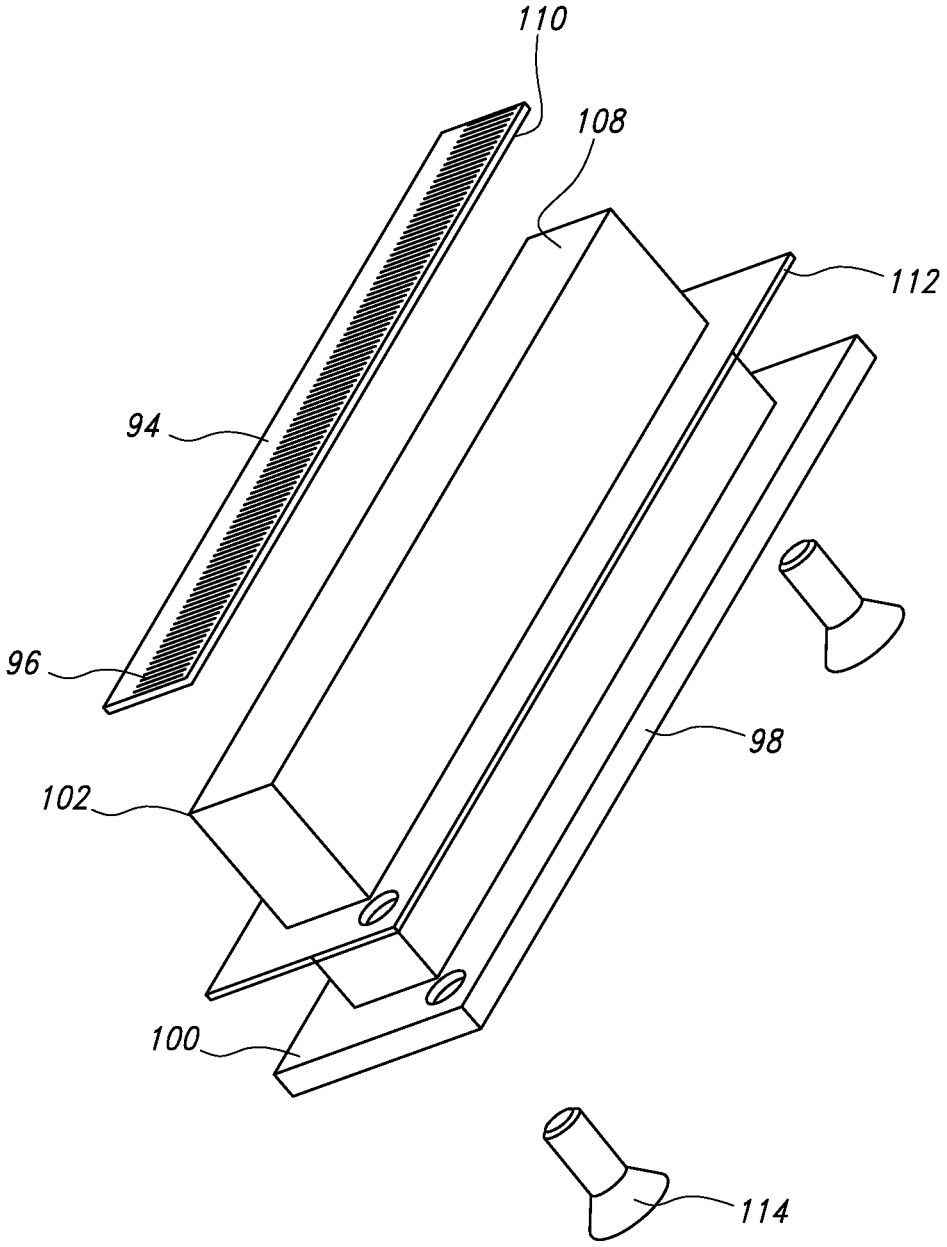
FIG. 15 is an isolated exploded perspective view of the scale support shown in FIGS. 12 and 13.

Referring now additionally to FIGS. 14 and 15, the coupler/encoder assembly 68 is assembled from a coupler body 76 onto which is attached two roller bearings 78 using flat head socket cap screws 79. The roller bearings 78 are similar to those described above and are located accurately within cylindrical bosses 80 machined on the coupler body to provide a prescribed gap 82 between their outside races. However, in this case, the guide element for the roller bearings is a rail 84 supported by the chassis, as opposed to the slot 21 described above. The gap 82 between the roller bearings 78, in this embodiment, is sized to receive the width of the rail 84 provided on a rail cover plate 86 of the chassis 64 shown in FIG. 12. Preferably, the gap 82 is sized for a close rolling relationship between the bearings 78 and the rail portion 84 such as to ensure minimal rotation of the coupler/encoder assembly 68 when linear actuator movement occurs.

An optical encoder 88 is securely attached to a face 90 of the coupler body 76 using cap screws 92. In a preferred embodiment, the optical encoder 88 is a 5 nm resolution encoder from Optira.

During operation, the coupler/encoder assembly 68 is carried back and forth in linear motion while being constrained from up/down motion by the piston 74, which, as described above with respect to its close fit inside the mating cylinder of the pump head 62, constrains motion to be aligned with the piston axis. Likewise the coupler/encoder assembly 68, as aforementioned, is constrained from rotation by engagement of its pair of bearings 78 with the rail portion 84 of the rail cover 86. These motion constraints allow use of a precision optical encoder 88, which must be maintained at a small accurate gap of 0.02 inch (i.e, "fly height") from an indicator face 94 of a scale 96. Absence of accuracy in this "fly height" can lead to damage of the sensitive encoder 88 or the scale 96 if too small and loss of readout if too large.

The optical encoder 88, which moves back and forth with the coupler/encoder assembly 68 coordinates with the scale 96, which is fixed with respect to the chassis 62 in order to provide position information. More specifically, the optical encoder 88 optically reads the indications provided on the indicator face 94 of the scale 96 as it linearly traverses with the coupler/encoder assembly 68. Since the optical/encoder assembly 68 is also fixed to the piston, 74, a relative accurate linear position of the piston can be determined.

Turning now to the challenge of fixing the encoder scale 96 at the proper location, while also maintaining correct "fly height" to the encoder 88, the present invention utilizes a novel separate encoder scale support bar 98 to addresses this challenge. As shown in FIG. 15, the encoder scale support bar 98 includes a flange portion 100 and a projection 102 extending from the flange portion. The flange portion 100 has a cross-section sized to fit within a cut-out 104 formed in a wall 106 of the chassis 64. The flange portion 100 extends outwardly beyond the cross-section of the projection 102 so as to provide a stop from further insertion of the projection into the interior of the chassis 64.

The cut-out 104 is positioned in the chassis wall 106 so as to be opposite the encoder 88, when the coupler/encoder assembly 68 is received within the chassis 64. The cut-out opening 104 is preferably precisely positioned in the wall 106 so as to yield exactly the desired location of the scale 96. Preferably, the cut-out opening 104 is also precisely sized to match the cross-section of the projection 102 so as to eliminate any movement or play between the projection and the opening.

The projection 102 of the support bar 98 has a face 108 opposite the flange 100 for fixing the scale 96 thereto. In a subassembly task, the edges of the scale 96 are carefully aligned with the edges of the face 108 of the projection 102. Once aligned, the back face 110, (opposite the indicator face 94), of the scale 96 is affixed with adhesive to the face 108 of the projection 102 of the encoder scale support bar 98. The projection 102, with the scale 96 affixed thereto, can then be inserted through the close-fitting opening 104 in the wall 106 of the chassis 64. As described above, the opening 104 is precisely positioned in the wall 106 so as to yield exactly the desired location of scale 18.

Any error found in "fly height" between the encoder 88 and the indicator face 94 of the scale 96 is readily corrected by changes to the height of projection 102 with respect to the flange 100. In practice, the projection 102 can be purposely made too high and different thickness rectangular shims 112 can be placed beneath the flange 100 when the encoder scale support bar 98 is secured to the wall 106 of the chassis 64 using screws 114.

This placement of the optical encoder 88 onto the moving coupler/encoder assembly 68 provides a means of direct monitoring of piston displacement. Any differences between desired—versus—actual piston displacement are detectable and, therefore, can be corrected. This closed loop arrangement is unaffected by such things as backlash, motor rotation error (such as step loss in a stepper motor), flexing attachment elements, lead screw pitch error, etc.

While various embodiments of the present invention are specifically illustrated and/or described herein, it will be appreciated that modifications and variations of the present invention may be effected by those skilled in the art without departing from the spirit and intended scope of the invention.

What is claimed is:

1. A syringe pump for aspirating and dispensing fluids, the syringe pump comprising:

a pump casing having an inlet port and an outlet port;

a ceramic piston liner received within the pump casing, the piston liner having an internal bore formed by a cylindrical wall, the cylindrical wall further defining a fluid path between the inlet port and the outlet port of the pump casing;

a ceramic piston axially movable within said bore of said piston liner to urge a flow of fluid between said inlet port and said outlet port via said fluid path;

an annular cartridge seal circumferentially sealing an outer surface of said ceramic piston at a proximal end of said piston liner;

an elastomeric annular washer disposed at said proximal end of said piston liner; and a gland nut attached to a proximal end of said pump casing, said gland nut pressing said annular washer against said cartridge seal, whereby said cartridge seal is pressed against an end face of said proximal end of said piston liner, wherein said cartridge seal comprises:

an annular shell having an inner circumferential lip portion, an outer circumferential flange portion and an annular groove formed between the inner circumferential lip portion and the outer circumferential flange portion; and a spring element received within said annular groove of said shell, said spring element radially urging said inner circumferential lip portion against said outer surface of said ceramic piston, and wherein an inner radial portion of said annular washer is axially pressed against the outer circumferential flange portion of said shell by said gland nut, and an outer radial portion of said annular washer is axially pressed against said end face of said proximal end of said piston liner by said gland nut, and wherein said gland nut has an axial face with an outer radial edge extending axially from an inner recessed axial surface, said outer radial edge pressing said outer radial portion of said annular washer against said end face of said proximal end of said piston liner and said inner recessed axial surface pressing said inner radial portion against said outer circumferential flange portion of said shell.

2. The syringe pump as defined in claim 1, wherein the internal bore of the piston liner has an inner diameter and the piston has an outer diameter, a clearance between the inner diameter and the outer diameter being in the range of 0.000100" to 0.000325".

3. The syringe pump as defined in claim 1, wherein the ceramic piston has an outer surface with a hardness on the Vickers scale of about 1700.

4. The syringe pump as defined in claim 1, further comprising an annular scraper seal disposed between said annular cartridge seal and said gland nut.

5. The syringe pump as defined in claim 4, wherein said scraper seal comprises: an annular shell having an inner circumferential lip portion, an outer flange portion and an annular groove formed between the scraper seal inner circumferential lip portion and the scraper seal outer flange portion; and a scraper seal spring element disposed within said scraper seal groove for radially urging said scraper seal inner circumferential lip portion against said outer surface of said ceramic piston.

6. The syringe pump as defined in claim 5, wherein said annular groove of said cartridge seal faces toward said piston liner, and said annular groove of said scraper seal faces away from said piston liner.

7. The syringe pump as defined in claim 1, wherein said fluid path comprises: a pair of axial slots formed in an outer radial surface of said cylindrical wall of said piston liner; and a transverse slot formed in an axial end face of said cylindrical wall of said piston liner, said transverse slot fluidly connecting said pair of axial slots.

8. The syringe pump as defined in claim 1, wherein said fluid path comprises: a pair of internal grooves formed on an inner radial surface of said internal bore of said piston liner; and a pair of transverse holes extending through said cylindrical wall of said piston liner.

9. The syringe pump as defined in claim 1, further comprising: a coupler attached to a distal end of a said ceramic piston, said coupler having a pair of roller bearings rotatably attached thereto; a chassis having an axial slot for receiving said pair of roller bearings of said coupler; and a drive mechanism for reciprocating said coupler in an axial direction, wherein each bearing of said pair of coupler roller bearings traverses a respective wall of opposing walls of said axial slot of said chassis.

10. The syringe pump as defined in claim 1, further comprising:

a coupler attached to a distal end of said piston, said coupler having a pair of roller bearings rotatably attached thereto;

a chassis having a guide element for engaging said pair of roller bearings of said coupler; and a drive mechanism for reciprocating said coupler in an axial direction, whereby each bearing of said pair of coupler roller bearings traverses said guide element of said chassis.

11. The syringe pump as defined in claim 10, wherein said guide element comprises an axial slot formed in said chassis for receiving said pair of roller bearings of said coupler, each bearing of said pair of roller bearings of said coupler traversing a respective wall of opposing walls of said axial slot of said chassis.

12. The syringe pump as defined in claim 11, wherein a first bearing of said pair of roller bearings is offset from a second bearing of the pair of roller bearings such that a gap of approximately 0.005" is created between an outer diameter of the first and second bearings.

13. The syringe pump as defined in claim 10, wherein said guide element comprises a rail supported by said chassis, each bearing of said pair of roller bearings of said coupler traversing an opposite side of said rail of said chassis.

14. The syringe pump as defined in claim 1, further comprising:

a coupler attached to a distal end of said piston, said coupler having an optical encoder attached thereto;

a chassis having a scale readable by the optical encoder of the coupler; and a drive mechanism for reciprocating said coupler in an axial direction, whereby an axial position of the piston is determined by the optical encoder.

15. The syringe pump as defined in claim 14, wherein the scale is attached to a scale support bar connected to the chassis, the scale support bar having a flange portion and a projection extending from the flange portion, the scale being attached to a face of the projection extending into an interior of the chassis.

16. The syringe pump as defined in claim 15, further comprising a shim placed beneath the flange portion for adjusting a distance between the scale and the encoder.

17. A syringe pump for aspirating and dispensing fluids, the syringe pump comprising:

a pump casing having an inlet port and an outlet port;

a ceramic piston liner received within the pump casing, the piston liner having an internal bore formed by a cylindrical wall, the cylindrical wall further defining a fluid path between the inlet port and the outlet port of the pump casing;

a ceramic piston axially movable within said bore of said piston liner to urge a flow of fluid between said inlet port and said outlet port via said fluid path;

an annular cartridge seal circumferentially sealing an outer surface of said ceramic piston at a proximal end of said piston liner;

an elastomeric annular washer disposed at said proximal end of said piston liner;

a gland nut attached to a proximal end of said pump casing, said gland nut pressing said annular washer against said cartridge seal, whereby said cartridge seal is pressed against an end face of said proximal end of said piston liner; and an annular scraper seal disposed between said annular cartridge seal and said gland nut, wherein said scraper seal comprises:

an annular shell having an inner circumferential lip portion, an outer flange portion and an annular groove formed between the inner circumferential lip portion and the outer flange portion; and a spring element disposed within said groove for radially urging said inner circumferential lip portion against said outer surface of said ceramic piston.

18. The syringe pump as defined in claim 17, wherein an annular groove of said cartridge seal faces toward said piston liner, and said annular groove of said scraper seal faces away from said piston liner.

19. The syringe pump as defined in claim 17, wherein said cartridge seal comprises: an annular shell having an inner circumferential lip portion, an outer circumferential flange portion and an annular groove formed between the cartridge seal inner circumferential lip portion and the cartridge seal outer circumferential flange portion; and a cartridge seal spring element received within said cartridge seal annular groove of said cartridge seal shell, said cartridge seal spring element radially urging said cartridge seal inner circumferential lip portion against said outer surface of said ceramic piston.

20. The syringe pump as defined in claim 19, wherein an inner radial portion of said annular washer is axially pressed against the cartridge seal outer circumferential flange portion of said cartridge seal shell by said gland nut, and an outer radial portion of said annular washer is axially pressed against said end face of said proximal end of said piston liner by said gland nut.

21. The syringe pump as defined in claim 20, wherein said gland nut has an axial face with an outer radial edge extending axially from an inner recessed axial surface, said outer radial edge pressing said outer radial portion of said annular washer against said end face of said proximal end of said piston liner and said inner recessed axial surface pressing said inner radial portion against said outer circumferential flange portion of said shell.

* * * * *